US005653487A

United States Patent [19]

Proni

[11] Patent Number: 5,653,487

[45] Date of Patent: Aug. 5, 1997

[54] DOOR STOPPING DEVICE

[76] Inventor: Alberto Proni, Via Bargello, 24/2, Castenaso (Bologna), Italy, 40055

[21] Appl. No.: 536,212

[22] Filed: Sep. 29, 1995

[30] Foreign Application Priority Data

Oct. 4, 1994 [EP] European Pat. Off. ..... 94830473

[51] Int. Cl.[6] ..... E05C 19/18

[52] U.S. Cl. ..... 292/288; 292/164; 292/255; 292/DIG. 15

[58] Field of Search ..... 292/163, 164, 292/255, 288, DIG. 15

[56] References Cited

U.S. PATENT DOCUMENTS

| | | | |
|---|---|---|---|
| 513,333 | 1/1894 | Lippincott | 292/288 |
| 565,896 | 8/1896 | Harkness | 292/288 |
| 628,795 | 7/1899 | Harkness | 292/288 |
| 1,036,098 | 8/1912 | Harkness | 292/288 |
| 2,459,070 | 1/1949 | Gard | 292/288 |
| 2,500,416 | 3/1950 | Kaminski | 292/288 |
| 3,143,369 | 8/1964 | Adams | 292/288 |
| 3,330,585 | 7/1967 | Pollin | 292/164 |
| 4,163,574 | 8/1979 | Chezem | 292/338 |
| 4,303,266 | 12/1981 | Volpi | 292/166 |
| 4,343,500 | 8/1982 | Steiner | 292/175 |
| 4,462,623 | 7/1984 | Grant | 292/175 |
| 5,018,241 | 5/1991 | Baines | 16/82 |
| 5,120,093 | 6/1992 | Carney | 292/60 |

FOREIGN PATENT DOCUMENTS

| | | |
|---|---|---|
| 1021116 | 11/1977 | Canada . |
| 328680 | 8/1919 | Germany . |
| 24 47 882 | 4/1976 | Germany . |
| 93 13 959.4 | 1/1994 | Germany . |
| 263600 | 9/1949 | Switzerland . |

*Primary Examiner*—Steven N. Meyers
*Assistant Examiner*—Donald J. Lecher
*Attorney, Agent, or Firm*—Darby & Darby

[57] ABSTRACT

A door stopping device comprises a bottom or base element, which when in use, rests stably on a floor and a cover or top element connected to the aforesaid base element and sliding coaxially up and down over it along a substantially vertical axis; the said top element has an integral flat ring protruding at right angles from its bottom edge and designed to engage the bottom edge of a door; elastic means apply a force in an upward direction between the base element and the top element which tends to draw the two elements apart and which, when an external force is applied along the same axis but in the direction opposite to that applied by the elastic means, defines at least one limit position of minimum extension where the said base element is completely covered by the said top element in such a way as to enable the said flat ring to be inserted under the bottom edge of the door; permanent latching means are provided to establish a reciprocal link between the aforesaid base and top elements and defining the position of maximum extension in which the said base and top elements are as far apart as possible.

5 Claims, 3 Drawing Sheets

F
F1
F2
F3
P
P'
1
2
3
3'
4
13
14
19
20
A

DOOR STOPPING DEVICE

BACKGROUND OF THE INVENTION

The present invention concerns a device for stopping doors and relates in particular to an accessory especially useful to stop a door in a partly or fully open position.

Door stops of various kinds have been known for some time. These devices are used to hold doors in a desired position overcoming the force exerted on them by wind and drafts blowing from one room to another or by any other of numerous factors.

The first devices of this kind were designed to be screwed, bolted or glued to the door and consisted basically of two elements, the first element being used to support the second which was designed to slide up and down (or rotate) in the first and to press against the floor. An example of one of these devices is illustrated in U.S. Pat. No. 4,163,574 which consists of a plurality of interconnected elements, the bottom one of which has, at its lower end, a small pad made of resilient material with a high friction coefficient. The said elements are shaped and interconnected in such a manner as to constantly exert a downward force which keeps the said bottom element against the floor. Although this type of device serves its purpose, the fact that the bottom element is permanently pressed against the floor gives rise to a number of disadvantages. The stopping action not only keeps the door open when it needs to stay open but also makes it difficult to close it when it needs to be closed. In addition, after being used for some time, it tends to scratch and score the floor.

Another disadvantage of this kind of device is that it must be attached to the door itself and fitting it causes irreversible damage to the surface of the door.

The market has therefore turned towards door stops which do not need to be attached to the door, such as, for example, the one described in German Patent application No. 2,447,882 which consists of a single, gently sloping, wedge-shaped element designed to be inserted into the gap between the bottom edge of the door and the floor. This type of device is fairly effective but, because the gap between the door and the floor is usually very narrow, it tends to slide out rather easily. Canadian patent No. 1,021,116 discloses yet another type of door stop consisting of a high-friction, resilient element designed to be fitted over the bottom edge of a door and to press permanently against the floor. This resilient element presents the same disadvantage as that of the aforementioned U.S. patent in that it provides a stopping action not only when the door has to stay open but also when the user wishes to close it.

SUMMARY OF THE INVENTION

The purpose of the present invention is to eliminate all the disadvantages described above by providing a device capable of being easily used with a door to prevent it from closing only when necessary, and to do this with the maximum efficiency without its use giving rise to any disadvantages.

BRIEF DESCRIPTION OF THE DRAWINGS

Further characteristics and advantages of the invention are apparent from the detailed description which follows, with reference to the accompanying drawings, which illustrate preferred embodiments of the invention by way of example and in which.

DESCRIPTION OF THE PREFERRED EMBODIMENTS

Figure 1:
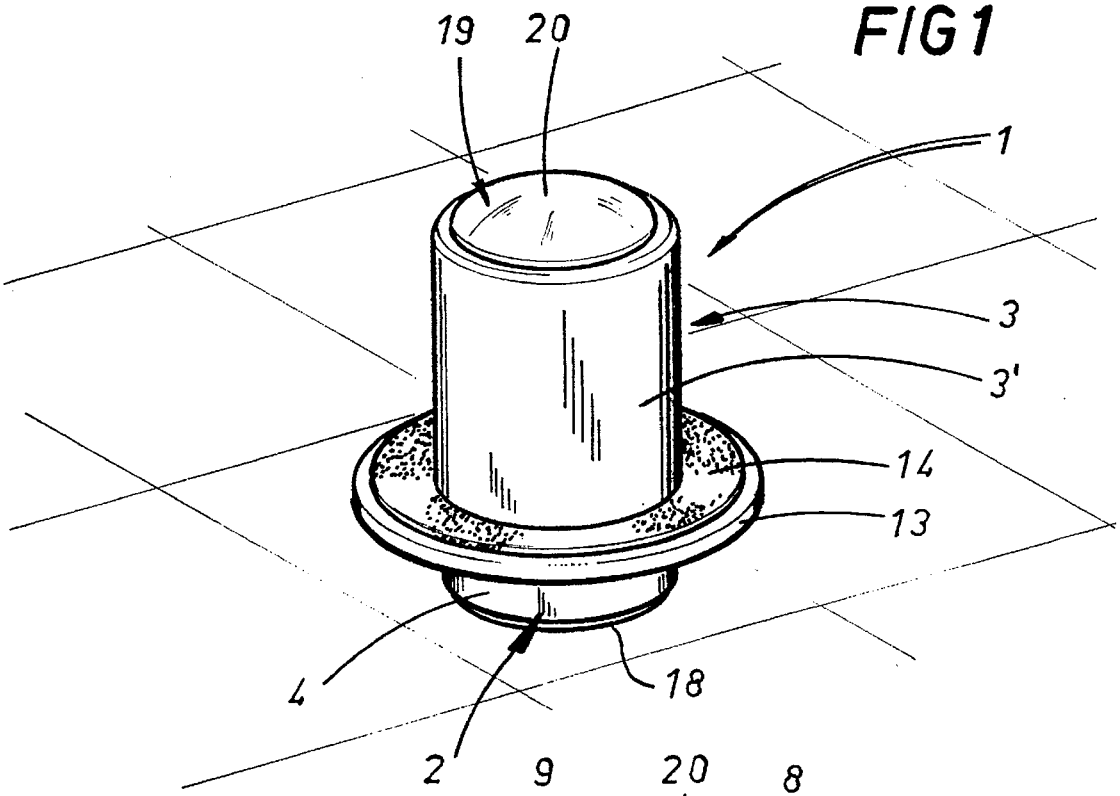
FIG. 1 is a top, perspective view of the door stopping device disclosed by the present invention.

The invention will now be described with reference to the drawings listed above, especially FIGS. 1 and 2. The numeral 1 indicates a door stopping device comprising a bottom or base element 2 and a cover or top element 3 reciprocally connected to each other.

The base element 2 includes a hollow cup 4, substantially cylindrical in shape (but could also have a polygonal cross section), with concavity facing up, from an internal axial area of which there extends upwards a substantially cylindrical stem 5, the bottom end of which, together with the central portion of the base of the cup 4 itself, forms a cylindrical cavity under the base element 2 and coaxial with the latter. The top end of the stem 5, indicated with the numeral 7 and forming part of permanent latching means 7 and 10, has substantially the shape of a truncated cone with the narrow end at the top; the diameter of the major base of the locking element 7 is slightly greater than the diameter of the body of the stem 5.

The top element 3 consists of a cup 3', hollow and substantially cylindrical in shape, with concavity facing down, a top circular surface 8 of which, when in use, lies in a horizontal plane and which has an axial, circular opening 9 from the edge of which there extends downwards a hollow cylindrical element 10 (forming the other part of the permanent latching means 7 and 10). The perimeter of the base of the cylindrical element 10 has coaxially attached to it a locking element 11 having substantially the shape of a truncated cone with the narrow end at the top and with at least one diametrical slot 12 designed to allow the side defining the locking element 11 itself to be deformed more easily. The diameter of the minor base of the locking element 11 is slightly smaller than the diameter of the major base of the locking element 7.

The circular, bottom edge of the cup 3' has an integral flat ring 13 protruding at right angles from the cup itself, a portion of the top surface of this ring being lined with an inset ring 14, also called stop ring, made of high-friction, resilient material (such as rubber, for example).

When the door stopping device 1 is assembled and being used, the top element 3 is coaxial with the base element 2 and the base element 2 itself, since its outer diameter is slightly smaller than the inner diameter of the cup 3', is partially contained in cup 3' itself and able to slide inside it. The locking element 11 coaxially engages the locking element 7, and the edge of the minor base of the locking element 11 adheres peripherally to the side surface of the stem 5 and skirts a lower peripheral edge of the major base of the locking element 7.

Figure 5:
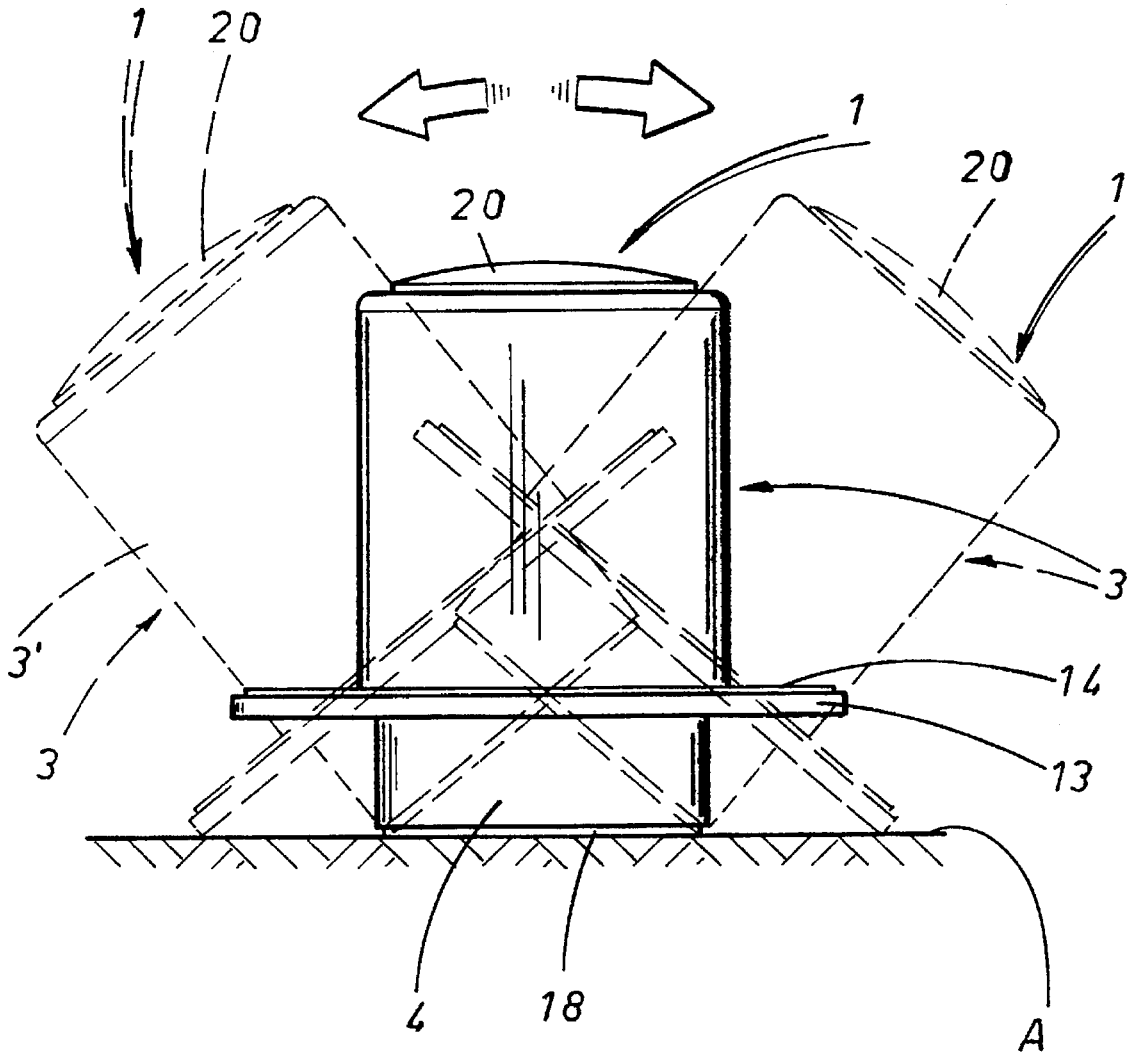
FIG. 5 is a front view illustrating the door stopping device disclosed by the present invention under certain foreseeable circumstances as for example when it is accidentally knocked.

The bottom, inner surface of the cup 4 has a ring-shaped block 15 placed coaxially over it, which acts both as a stopping element for an axial end of elastic means consisting of a helical spring 16, fitted coaxially around the stem 5 and opposed at the top by the top inner surface of the cup 3' which counterbalances the cup 4 so as to enable it to remain in a constantly upright position, that is, perpendicular to the floor A: in other terms, the ring-shaped block 15 enables the door stopping device to remain upright at all times even when the user moves it along the floor with his foot, thus making it unnecessary for the user to bend down to put it in the correct position (see detail in FIG. 5).

An upper portion of the aforesaid helical spring 16 skirts the cylindrical element 10 and the top end of the helical spring 16 is compressed lightly against a portion of the circular, top inner surface of the cup 3'.

The interior of the cylindrical cavity 6, under the base surface of the cup 4, accommodates a cylindrical element 17, made of a high-friction material, whose base 18 extends over the entire underside of the base of cup 4 from which it protrudes slightly so as to guarantee the maximum stopping action from the high-friction material. The top end portion of the hollow cylindrical element 10 partially accommodates a cap 19, with a rounded disc-shaped top (20), designed to receive and transmit operating pressure exerted by the user's foot (or hand), and skirting the horizontal top surface of the cup 3', in such a way as to close it.

Figure 2:
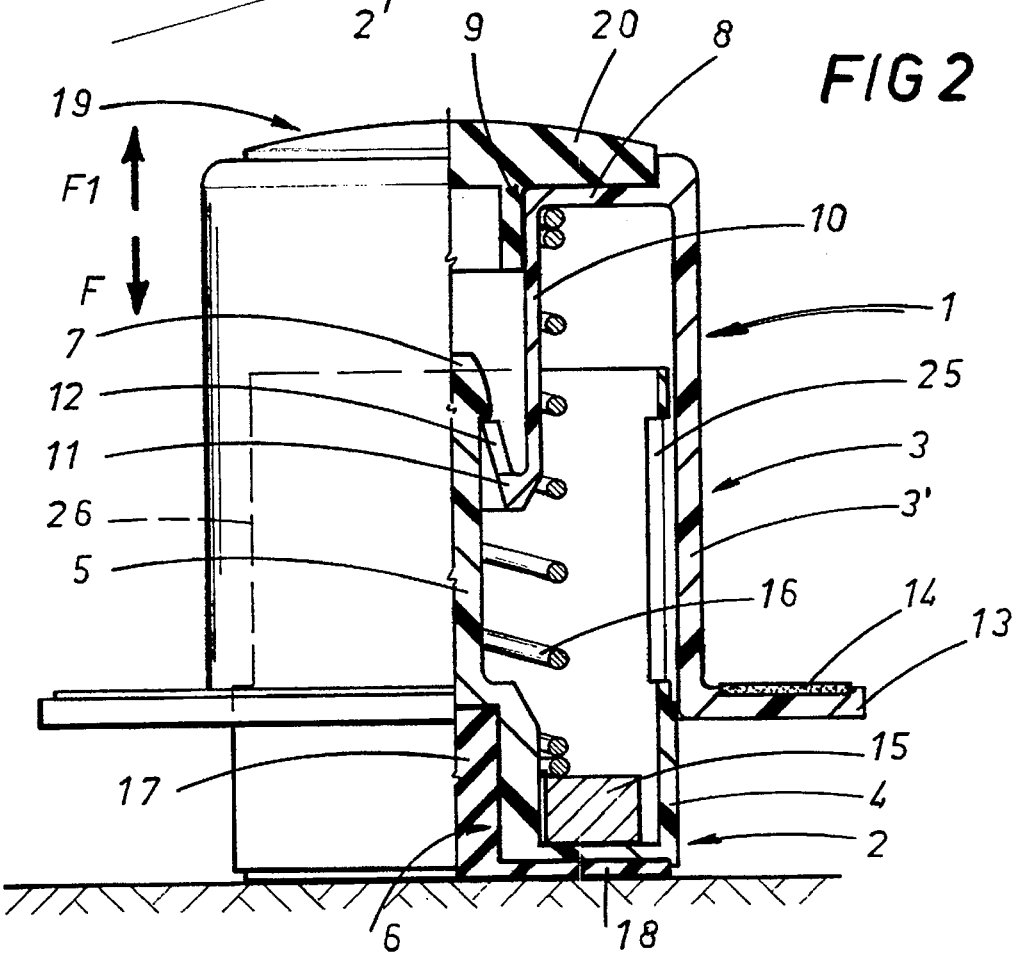
FIG. 2 is a front view, partly in cross-section, of the door stopping device illustrated in FIG. 1.

As shown in FIG. 2, the bottom cup 4 has two openings 25 and 26 in its side designed to enable means (not illustrated) for working the stem 5 of the cup 4 to pass through the cup radially and bilaterally during the manufacture of the cup itself.

Figures 3A, 3B, 3C, 3D, 4:
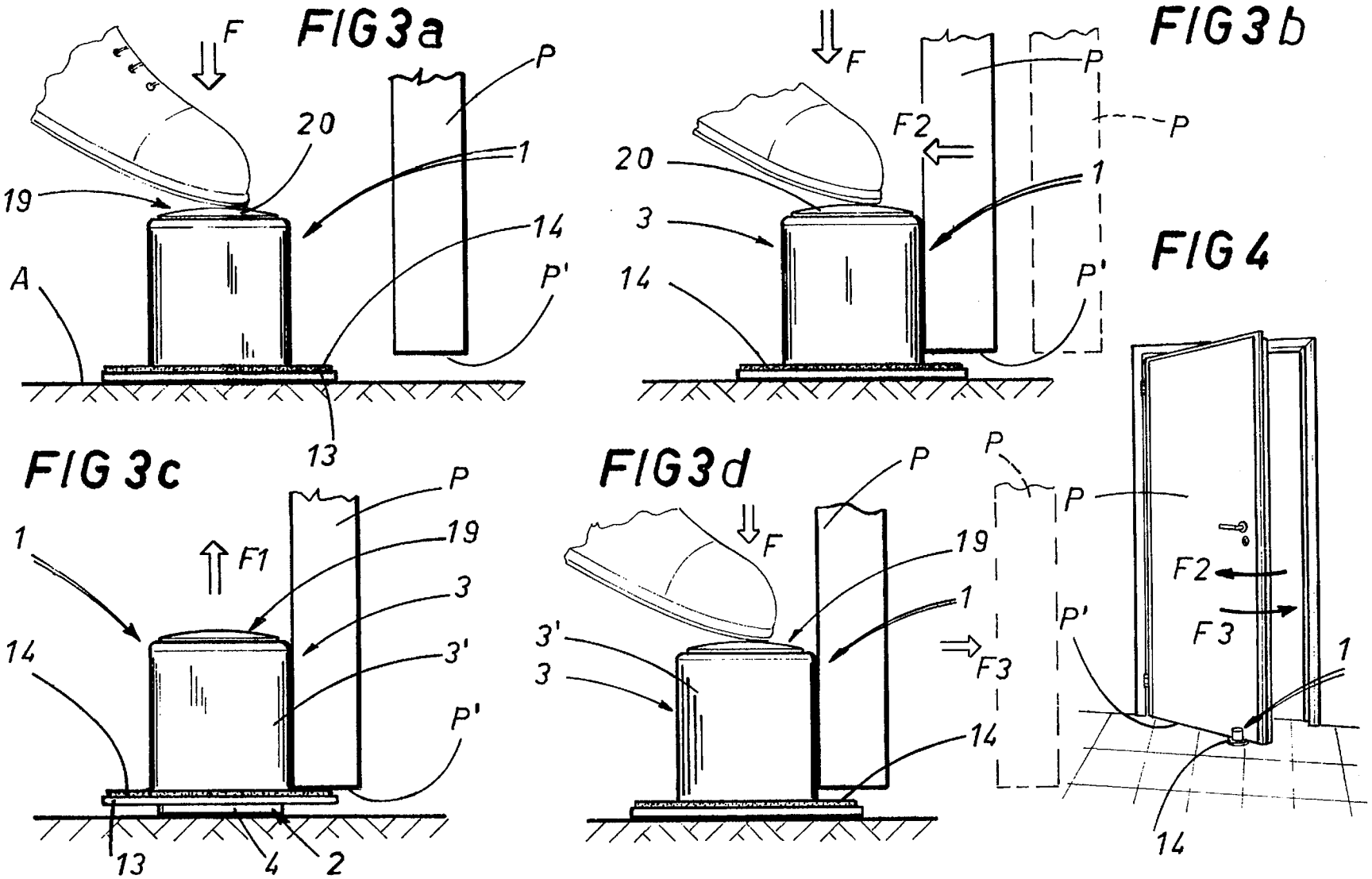
FIGS. 3*a* to 3*d* are schematic, front views showing the door stopping device illustrated in the previous drawings during different stages of use, that is, stopped against a door.
FIG. 4 is a front perspective view showing the door stopping device illustrated in the previous drawings in operation against a door.

To use the door stopping device 1, it is necessary to move the device 1 itself up close to a door P which has been opened to the position where it is to be stopped, placing the device 1 with the base 18 horizontal and resting against a floor A (see FIG. 3*a*). Next the user must press the cap 20 of cup 3' (see arrow F, FIG.3*a*) with his foot (or hand) until the ring 13 comes into contact with the floor A. This action causes cup 4 to be pushed into cup 3', compresses the helical spring 16 and lowers the flat ring element 13 with its inset lining ring 14 in high-friction, resilient material to floor level.

While the door stopping device is kept in the position illustrated in FIG. 3*a*, the door P must be moved up against the cup 3' of the door stopping device itself (FIG. 3*b*). The user may now take his foot away from the cup 3' thus releasing the helical spring 16 which causes the inset ring 14 of the top cup 3' and the base 18 of the bottom cup 4, both made of high-friction, resilient material, to exert a strong pressure against the bottom edge P' of the door P and against the floor A, respectively, and thus securely stopping the door in the desired position (see FIG. 3*c*).

Obviously, to release the door P, it is sufficient for the user to press cup 3' again with his foot and move the door away from the door stopping device 1 (see FIG. 3*d*).

The invention described can be subject to modifications and variations without thereby departing from the scope of the inventive concept. Moreover, all the details of the invention may be substituted by technically equivalent elements.

What is claimed:

1. A door stopping device comprising:

a base element to rest stably on a floor, said base element having an upwardly projecting stem;

a cover interfitting on said base element and sliding coaxially up and down over it along a substantially vertical axis, said cover having a hollow frustro-conical member of deformable material into which said upwardly projecting stem extends, said cover having an integral ring protruding substantially at a right angle from and complete around its bottom edge and having an upper surface to engage the bottom edge of a door;

elastic means applying a force in an upward direction between said base element and said cover to move said base element and said cover apart, an external force applied to said cover along the vertical axis in the direction opposite to that applied by the elastic means moving said cover to a point defining at least one limit position of minimum extension of said cover relative to said base element where the said base element is completely covered by said cover and said cover ring lower surface can contact the floor and said ring is in a position to be inserted under the bottom edge of the door, release of the external force permitting the cover to move apart from said base and upwardly such that the top surface of said ring can engage the bottom of the door; and cooperating latching means comprising a projection on the upper end of said base element stem which is forced through the open top of said cover frustro-conical member to engage the top edge thereof to define the position of maximum extension of said cover relative to said base element by said elastic means.

2. The door stopping device according to claim 1 wherein said elastic means is a spring between the interfitting base element and cover.

3. The door stopping device according to claim 1 further comprising second stopping means on at least a part of said ring element top surface in the form of an inset ring of high-friction material to engage the bottom edge of the door.

4. The door stopping device according to claim 1 wherein the inside base surface of the said base element includes a ring-shaped block acting as an end stop for said elastic means and as a counterweight to enable the base element to maintain a constantly upright position with respect to the floor.

5. The door stopping device according to claim 1 wherein the top end of said cover partially accommodates a cap with a disc-shaped top forming the horizontal top surface of said cover to receive the pressure applied by an external force.

* * * * *

UNITED STATES PATENT AND TRADEMARK OFFICE

CERTIFICATE OF CORRECTION

PATENT NO. : 5,653,487

DATED : August 5, 1997

INVENTOR(S) : Alberto PRONI

It is certified that error appears in the above-identified patent and that said Letters Patent is hereby corrected as shown below:

Title page, [30], Foreign Application Priority, change "94830473" to --94830473.8--.

Signed and Sealed this

Second Day of December, 1997

*Attest:*

*Attesting Officer*

Bruce Lehman

BRUCE LEHMAN

*Commissioner of Patents and Trademarks*